US006749093B2

(12) United States Patent
Harris

(10) Patent No.: US 6,749,093 B2
(45) Date of Patent: Jun. 15, 2004

(54) ALTERNATING BELT HANGER

(76) Inventor: Anthony Nathaniel Harris, 1114 Peacock Ave. NE., Palm Bay, FL (US) 32907

( * ) Notice: Subject to any disclaimer, the term of this patent is extended or adjusted under 35 U.S.C. 154(b) by 0 days.

(21) Appl. No.: 10/208,319

(22) Filed: Jul. 30, 2002

(65) Prior Publication Data

US 2004/0020948 A1 Feb. 5, 2004

(51) Int. Cl.[7] ..... A41D 27/22
(52) U.S. Cl. ..... 223/85; 223/DIG. 1
(58) Field of Search ..... 223/85, DIG. 1; 211/119; D6/317; 256/2, 6

(56) References Cited

U.S. PATENT DOCUMENTS

| | | | | | |
|---|---|---|---|---|---|
| 381,888 | A | | 4/1888 | Rice | |
| 2,025,114 | A | * | 12/1935 | Legus | 223/88 |
| 2,150,869 | A | | 3/1939 | Hanger | |
| 2,575,979 | A | | 11/1951 | Simon et al. | |
| 2,741,408 | A | | 4/1956 | Brokenshire | |
| 2,793,762 | A | | 5/1957 | Broussard | |
| 3,194,457 | A | | 7/1965 | Freilich | |
| 3,268,088 | A | | 8/1966 | Lowhorn | |
| 3,945,543 | A | * | 3/1976 | Lazaroff | 223/88 |
| 4,368,823 | A | | 1/1983 | Beckwith | |
| D280,048 | S | * | 8/1985 | Benedict | D6/328 |
| D334,291 | S | * | 3/1993 | Rooke | D6/317 |
| 5,303,855 | A | * | 4/1994 | Veale | 223/85 |
| D378,475 | S | * | 3/1997 | Brown | D6/317 |
| 5,642,817 | A | | 7/1997 | O'Brien | |
| D432,319 | S | * | 10/2000 | Bartholow | D6/319 |
| 6,206,209 | B1 | | 3/2001 | Houg-Brown | |

* cited by examiner

*Primary Examiner*—John J. Calvert
*Assistant Examiner*—James G Smith
(74) *Attorney, Agent, or Firm*—John Wiley Horton

(57) ABSTRACT

A modified clothes hanger configured to suspend belts from a clothing rod. The device has a hook on its upper extreme, and a transverse beam on its lower extreme. A series of alternating prongs extend outward and upward from the transverse beam. The hook is placed over the clothing rod to install the device in a closet. The belt buckle of each belt to be hung is placed over one of the alternating prongs. The prongs are positioned and oriented so that the resulting weight placed on the hanger is well balanced. A variety of embodiments are described, including a hanger formed as one piece from molded plastic.

14 Claims, 7 Drawing Sheets

ALTERNATING BELT HANGER

CROSS-REFERENCES TO RELATED APPLICATIONS

Not Applicable.

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

This invention relates to the field of clothing storage. More specifically, the invention comprises a belt hanger which can be used for organizing belts and hanging them from a clothing rod found in a typical residential closet.

2. Description of the Related Art

Most men and women possess several belts for use with a variety of clothing. These belts are often stored in the closet where the clothes are kept. However, because the belts are not easily hung using the same devices as the clothes, storage can be a problem. Many prior art devices address this problem. Perhaps the most common belt storage device is a peg board having a series of extending pegs. A belt buckle is passed over each peg to suspend a belt therefrom.

The peg boards are flat objects which must typically be installed on a wall. The area immediately in front of the peg board must be kept clear in order to provide unfettered access. The combination of these two requirements means that a peg board consumes considerable space. In a smaller closet, this consumption of space is a significant disadvantage.

BRIEF SUMMARY OF THE INVENTION

The present invention comprises a modified clothes hanger configured to suspend belts from a clothing rod. The device has a hook on its upper extreme, and a transverse beam on its lower extreme. A series of alternating prongs extend outward and upward from the transverse beam The hook is placed over the clothing rod to install the device in a closet The belt buckle of each belt to be hung is placed over one of the alternating prongs The prongs are positioned and oriented so that the resulting weight placed on the hanger is well balanced. A variety of embodiments are described, including a hanger formed as one piece from molded plastic

REFERENCE NUMERALS IN THE DRAWINGS

| | | | |
|---|---|---|---|
| 10 | belt hanger | 12 | hook |
| 14 | twist joint | 16 | support leg |
| 18 | beam | 20 | prong |
| 22 | spot weld | 24 | belt |
| 26 | belt buckle | 28 | molded belt hanger |
| 30 | strap portion | 32 | unitary belt hanger |
| 34 | wire loop prong | | |

DETAILED DESCRIPTION OF THE INVENTION

Figure 1:
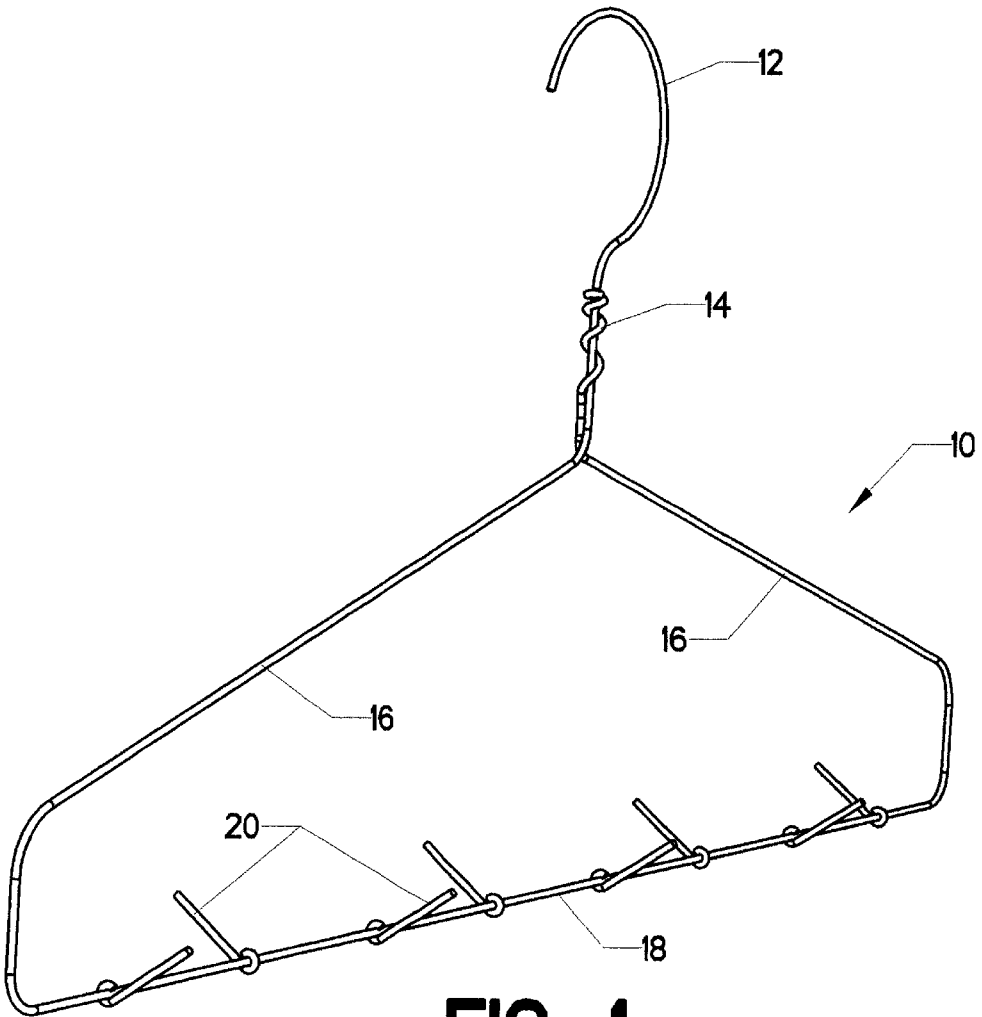
FIG. 1 is a perspective view, showing the present invention.

FIG. 1 shows one embodiment of the present invention. Hook 12 suspends the device, typically from a clothes rod located in a closet, armoire, or other storage facility Two support legs 16 extend out from the lower portion of hook 12. These suspend beam 18 in an orientation which is transverse with respect to the orientation of the clothes rod Belt hanger 10 can be inexpensively made form a length of twisted wire. In such an embodiment, the two ends of the wire are coupled together at twist joint 14.

Figure 2:
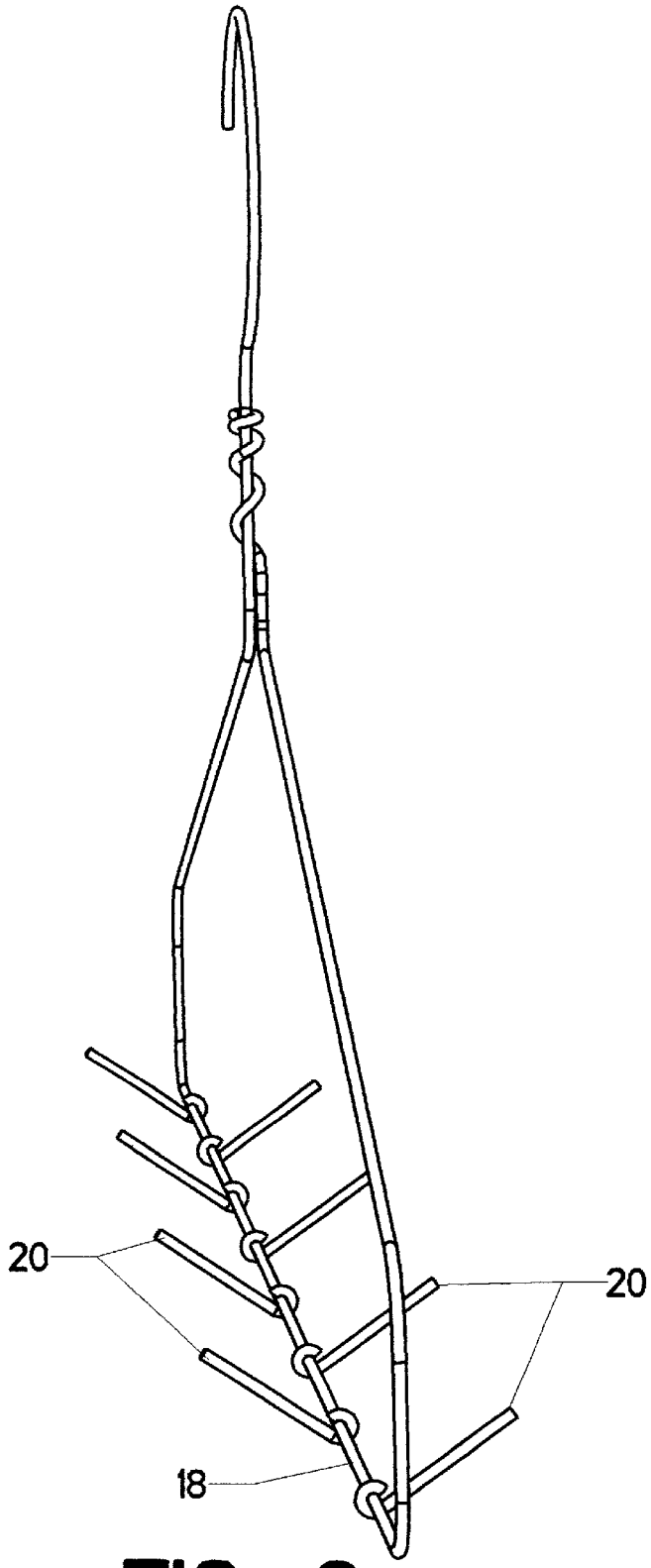
FIG. 2 is a perspective view, showing the present invention from another angle

A series of alternating prongs 20 extend outward and upward from beam 18. FIG. 2 shows these features from another perspective. The reader will observe that each prong 20 has a first end connected to beam 18 and a second end extending outward from beam 18. Each prong 20 slants upward; i.e., the second end of each prong 20 lies above beam 18. The reader will also observe that successive prongs extend outward from opposite sides of beam 18.

Figure 3:
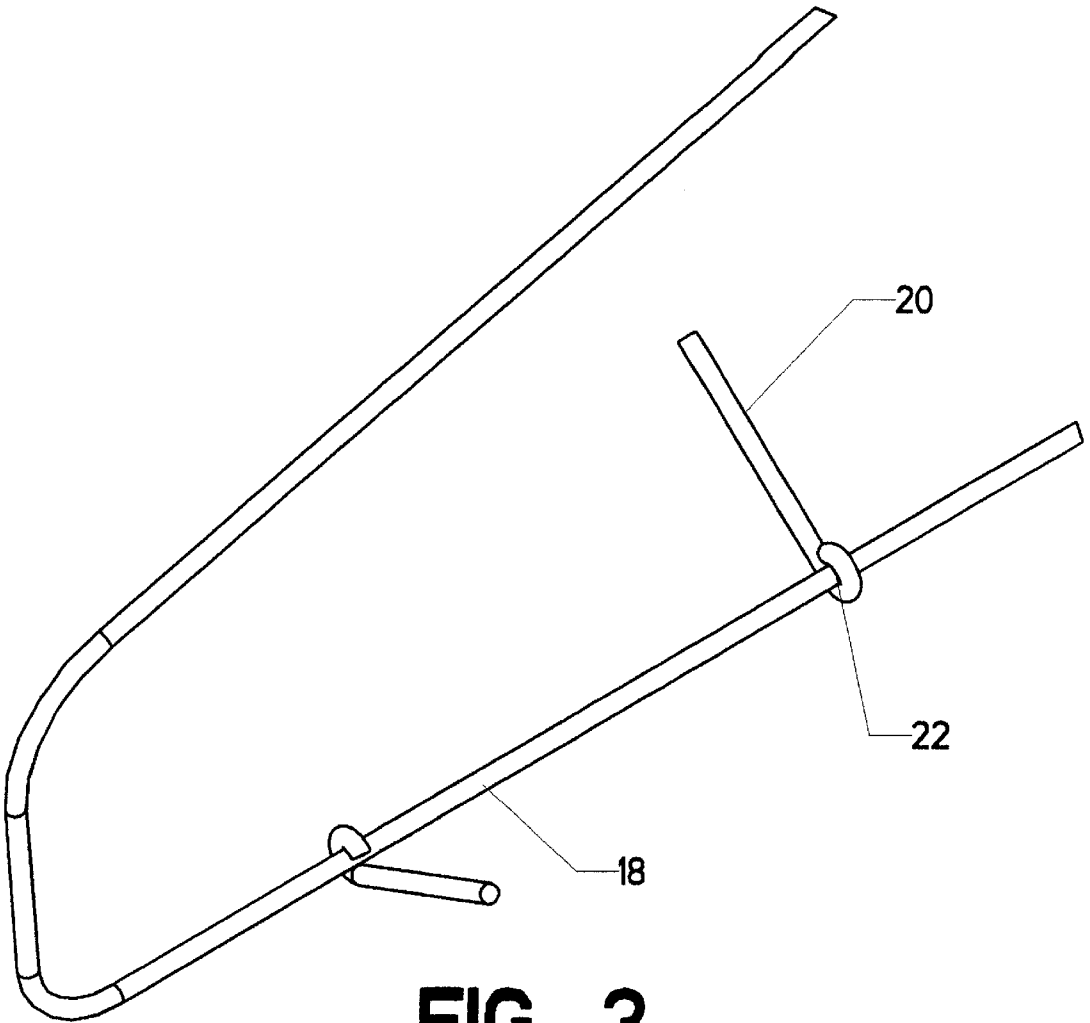
FIG. 3 is a detail view, showing how the prongs are attached to the beam.
Figure 4:
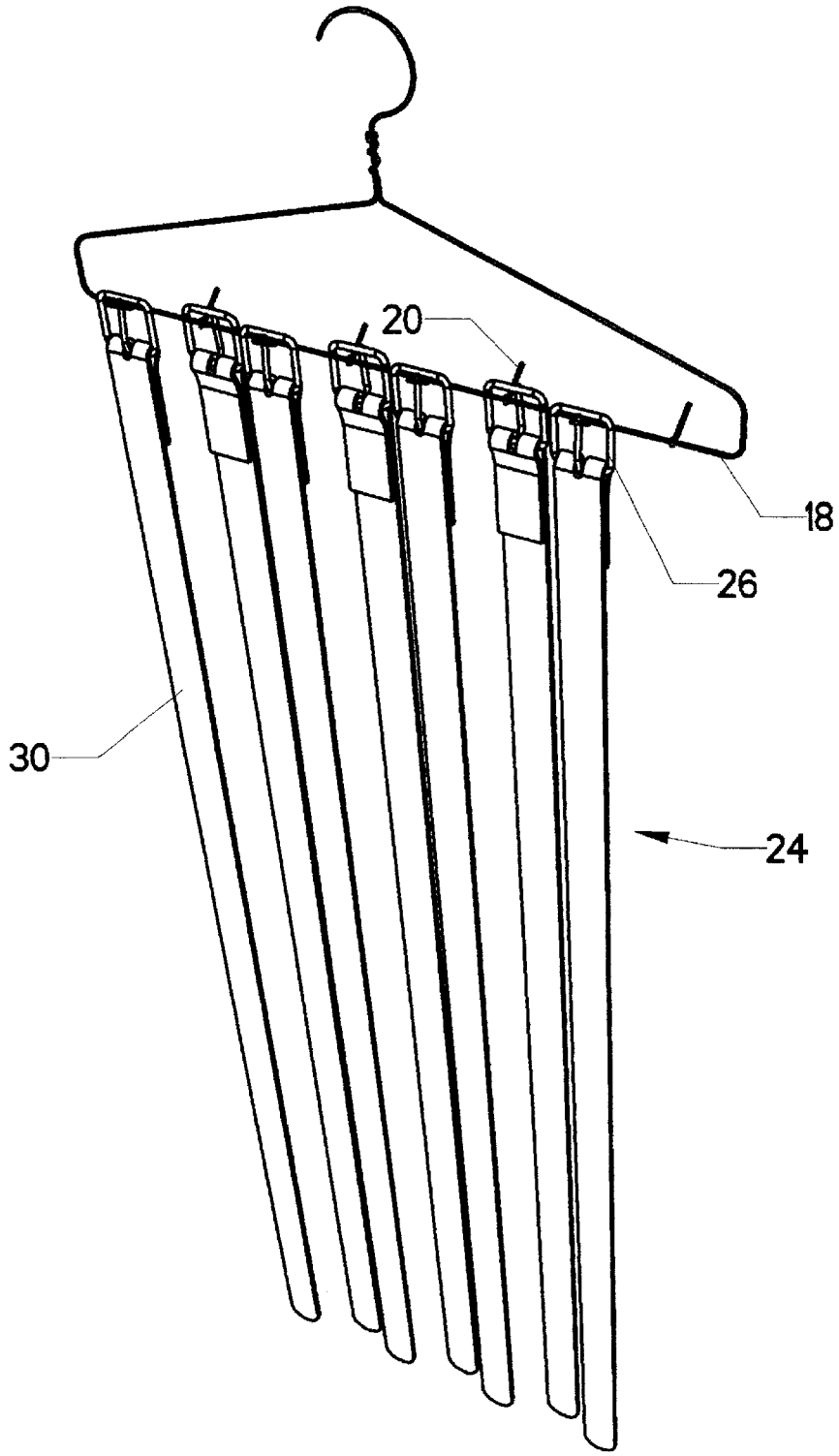
FIG. 4 is a perspective view, showing the invention in use.

FIG. 3 shows a prong 20 in great detail. The portion immediately adjacent to beam 18 is joined thereto by spot weld 22. Many different methods could be used to make this joint including brazing, mechanical interlocking, or the application of adhesives FIG. 4 shows the invention in use. A series of belts 24 have been suspended from prongs 20 by placing the belt buckles 26 over the prongs 20. Strap portions 30 hang down beneath. When hung on a clothing rod, belts 24 are suspended in an orientation which is parallel to the surrounding clothing.

Figure 5:
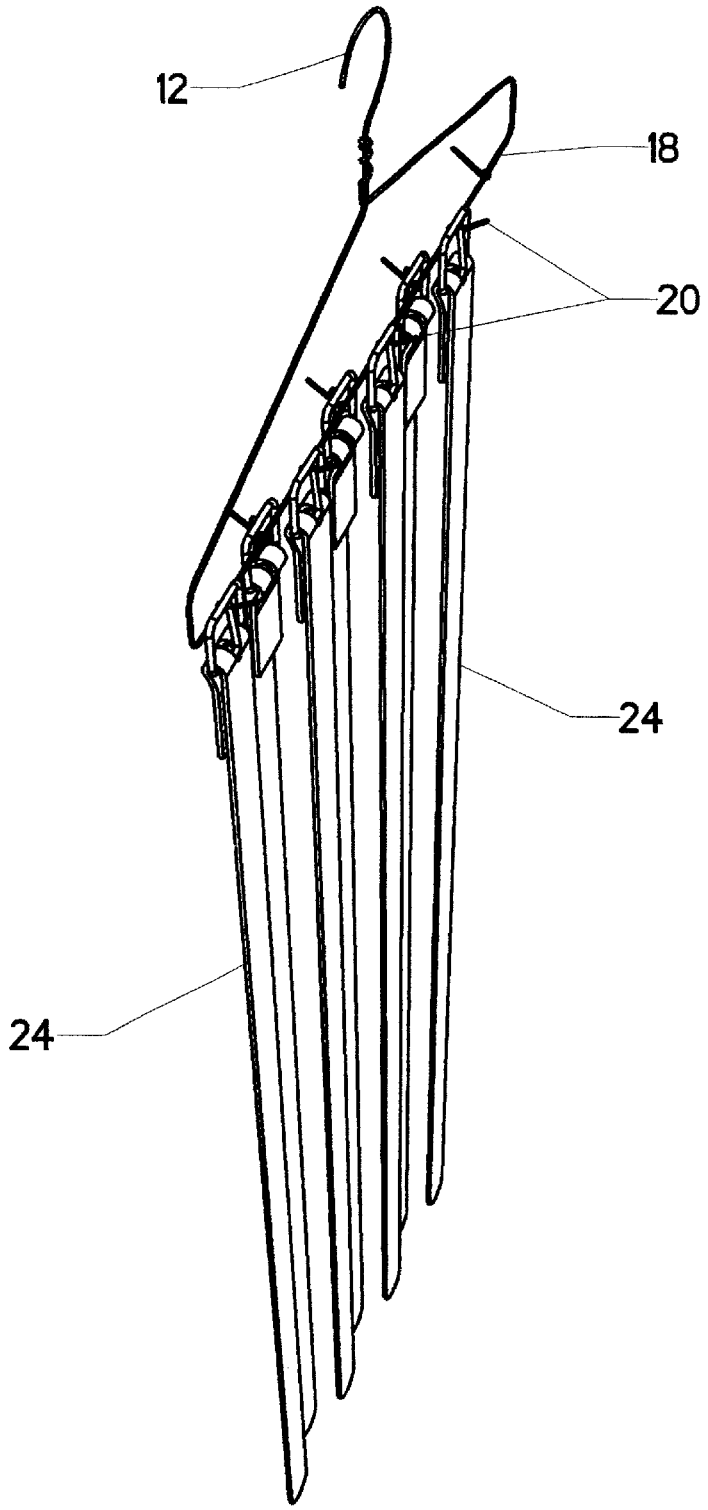
FIG. 5 is a perspective view, showing the invention in use.

FIG. 5 shows the invention with the belts attached from another perspective. Those skilled in the art will know that the placement of alternating prongs 20 on opposite sides of beam 18 helps to balance the device so that it will hang straight.

Figure 6:
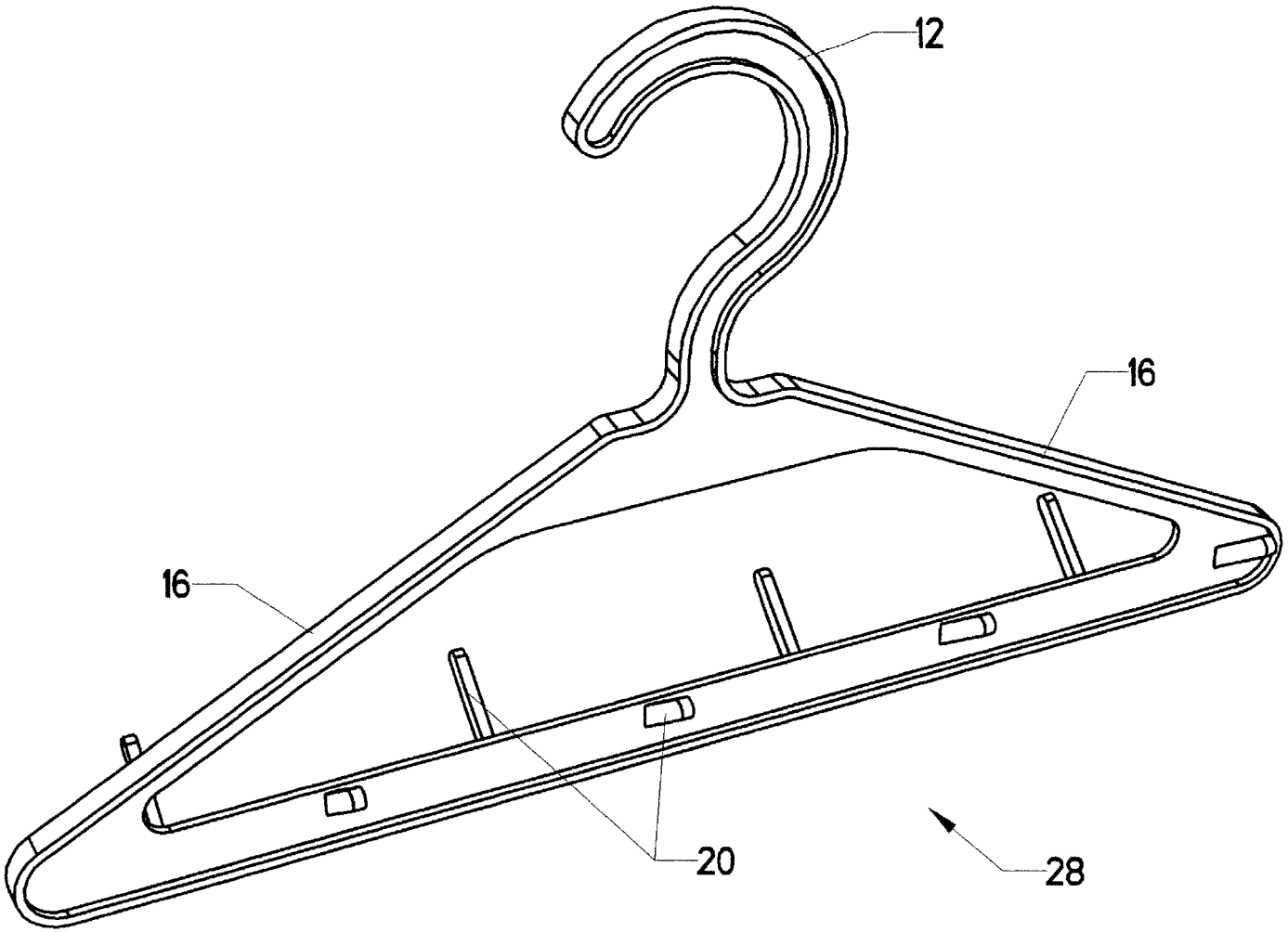
FIG. 6 is a perspective view, showing an alternate embodiment.

FIG. 6 shows an alternate embodiment wherein all the features of belt hanger 10 have been molded as one integral piece, typically of thermoplastic The use of plastic material necessitates some alterations, such as thickening the parts to provide sufficient strength. Nevertheless, the reader will observe that al the features of the embodiment presented in FIG. 1 are present in the molded embodiment as well.

Figure 7:
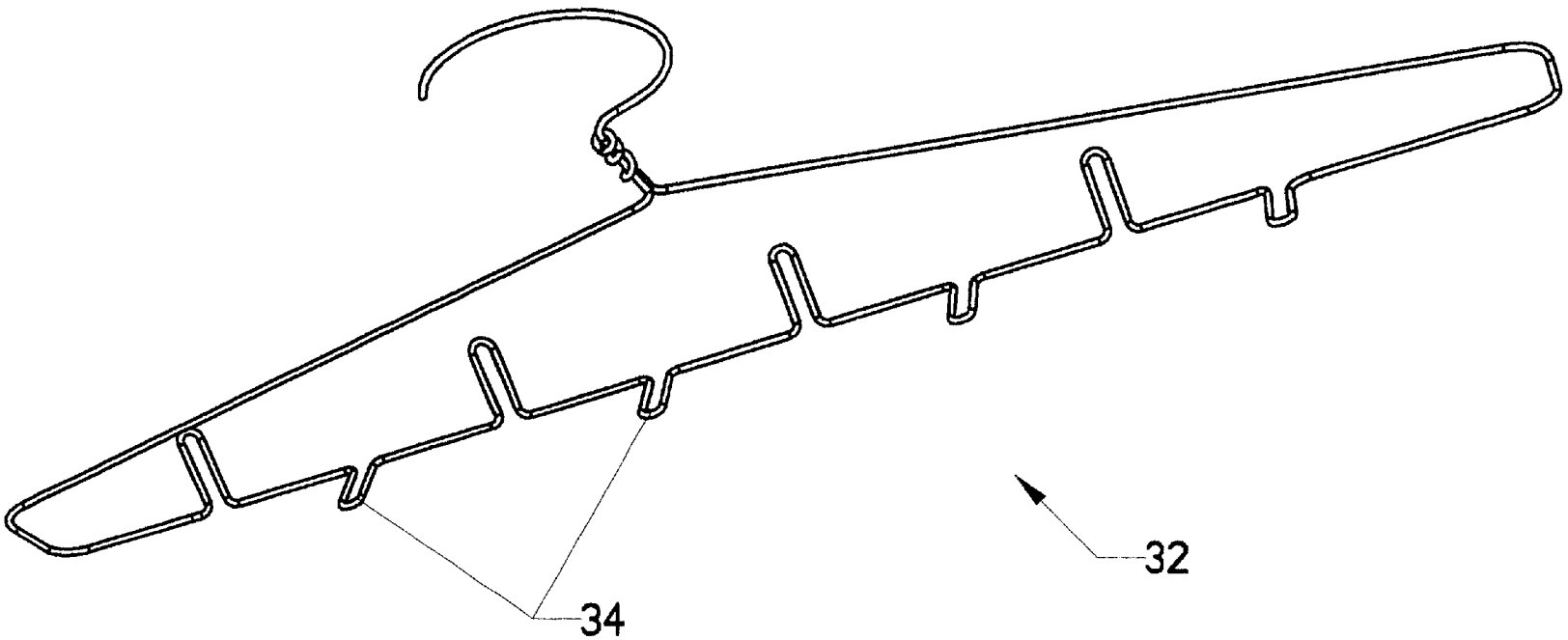
FIG. 7 is a perspective view, showing another alternate embodiment.

FIG. 7 shows another alternate embodiment—denoted as unitary belt hanger 32—which can be formed as a single piece of wire. The prongs are located and oriented the same as for the prior embodiments. However, they are formed as wire loop prongs 34. These are simply bends in the main piece of wire, rather than separate pieces joined to the main piece Many different modifications could be made to the design thus disclosed without altering the significant features of the invention. As one example, hook 12 could be replaced by a VELCRO-fastened strap or a spring-loaded clip. The preceding descriptions should therefore not be construed as limiting the scope of the invention but rather as providing illustrations of the preferred embodiments of the invention. Thus, the scope of the invention should be fixed by the following claims, rather than by the examples given.

Having described my invention, I claim:

1. A belt hanger for suspending a plurality of belts on a clothing rod, comprising:

a. attachment means for removably attaching said belt hanger to said clothing rod;

b. a beam, having a first side and a second side, connected to said attachment means so that said beam lies beneath said clothing rod and so that said beam is oriented transversely with respect to said clothing rod;

c. a first prong extending outward from said first side of said beam, having a first end and a second end, wherein said first end of said first prong is connected to said beam, and wherein said second end of said first prong lies above said beam;

d. a second prong extending outward from said second side of said beam, having a first end and a second end, wherein said first end of said second prong is connected to said beam, and wherein said second end of said second prong lies above said beam;

e. wherein said first prong is a length of wire separate from said beam, with said first end of said first prong being wrapped around said beam and attached thereto; and f. wherein said second prong is a length of wire separate from said beam, with said first end of said second prong being wrapped around said beam and attached thereto.

2. A belt hanger as recited in claim 1, further comprising a third prong extending outward from said first side of said beam, having a first end and a second end, wherein said first end of said third prong is connected to said beam, and wherein said second end of said third prong lies above said beam, and wherein said third prong is a length of wire separate from said beam, with said first end of said third prong being wrapped around said beam and attached thereto.

3. A belt hanger as recited in claim 2, further comprising a fourth prong extending outward from said second side of said beam, having a first end and a second end, wherein said first end of said fourth prong is connected to said beam, and wherein said second end of said fourth prong lies above said beam, and wherein said fourth prong is a length of wire separate from said beam, with said first end of said fourth prong being wrapped around said beam and attached thereto.

4. A belt hanger as recited in claim 3, further comprising a fifth prong extending outward from said first side of said beam, having a first end and a second end, wherein said first end of said fifth prong is connected to said beam, and wherein said second end of said fifth prong lies above said beam and wherein said fifth prong is a length of wire separate from said beam, with said first end of said fifth prong being wrapped around said beam and attached thereto.

5. A belt hanger as recited in claim 4, further comprising a sixth prong extending outward from said second side of said beam, having a first end and a second end, wherein said first end of said sixth prong is connected to said beam, and wherein said second end of said sixth prong lies above said beam, and wherein said sixth prong is a length of wire separate from said beam, with said first end of said sixth prong being wrapped around said beam and attached thereto.

6. A belt hanger as recited in claim 5, further comprising a seventh prong extending outward from said first side of said beam, having a first end and a second end, wherein said first end of said seventh prong is connected to said beam, and wherein said second end of said seventh prong lies above said beam, and wherein said seventh prong is a length of wire separate from said beam, with said second end of said seventh prong being wrapped around said beam and attached thereto.

7. A belt hanger as recited in claim 6, further comprising an eighth prong extending outward from said second side of said beam, having a first end and a second end, wherein said first end of said eighth prong is connected to said beam, and wherein said second end of said eighth prong lies above said beam, and wherein said eighth prong is a length of wire separate from said beam, with said first end of said eighhth prone being wrapped around said beam and attached thereto.

8. A belt hanger as recited in claim 1, wherein said attachment means comprises a hook.

9. A belt hanger as recited in claim 2, wherein said attachment means comprises a hook.

10. A belt hanger as recited in claim 3, wherein said attachment means comprises a hook.

11. A belt hanger as recited in claim 4, wherein said attachment means comprises a hook.

12. A belt hanger as recited in claim 5, wherein said attachment means comprises a hook.

13. A belt hanger as recited in claim 6, wherein said attachment means comprises a hook.

14. A belt hanger as recited in claim 7, wherein said attachment means comprises a hook.

* * * * *